US008107870B2

(12) United States Patent
Inoue et al.

(10) Patent No.: US 8,107,870 B2
(45) Date of Patent: Jan. 31, 2012

(54) FUSING DEVICE AND IMAGE FORMING APPARATUS USING THE SAME

(75) Inventors: Noriko Inoue, Yamatokoriyama (JP); Yoshinobu Tateishi, Nara (JP); Hiroaki Hori, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 442 days.

(21) Appl. No.: 12/335,243

(22) Filed: Dec. 15, 2008

(65) Prior Publication Data

US 2009/0185840 A1 Jul. 23, 2009

(30) Foreign Application Priority Data

Jan. 18, 2008 (JP) ..... 2008-009184

(51) Int. Cl.
*G03G 15/20* (2006.01)

(52) U.S. Cl. ..... 399/331

(58) Field of Classification Search ..... 399/328, 399/330, 331

See application file for complete search history.

(56) References Cited

U.S. PATENT DOCUMENTS

| | | | | |
|---|---|---|---|---|
| 4,972,232 | A * | 11/1990 | Hoover et al. | 399/122 |
| 7,546,077 | B2 * | 6/2009 | Hong et al. | 399/328 |
| 2003/0016974 | A1 * | 1/2003 | Kiuchi | 399/328 |
| 2007/0110487 | A1 * | 5/2007 | Kim et al. | 399/328 |

FOREIGN PATENT DOCUMENTS

| | | | |
|---|---|---|---|
| JP | 63-78189 A | * | 4/1988 |
| JP | 63-228183 A | | 9/1988 |
| JP | 64-087444 A | | 3/1989 |
| JP | 2-34887 A | * | 2/1990 |
| JP | 8-22214 A | | 1/1996 |
| JP | 11-194642 A | * | 7/1999 |
| JP | 2000-131994 A | | 5/2000 |
| JP | 2001-183938 A | | 7/2001 |
| JP | 2002-174978 A | | 6/2002 |
| JP | 2003-337489 A | | 11/2003 |
| JP | 2006-201512 A | * | 8/2006 |
| JP | 2007-248654 A | | 9/2007 |

* cited by examiner

*Primary Examiner* — David Gray

*Assistant Examiner* — Frederick Wenderoth

(74) *Attorney, Agent, or Firm* — Birch, Stewart, Kolasch & Birch

(57) ABSTRACT

A fusing unit is comprised of a pair of rollers, a fusing roller and a pressing roller, having an elastic layer on their outer peripheral surface and a pressing spring for pressing the fusing roller against the pressing roller, and causes a sheet of paper with an unfixed toner image to pass through the nip portion where the fusing roller and pressing roller are put in press-contact with each other so as to fuse the toner image and fix it to the paper. This fusing device further includes a roller member regulator for regulating the press-contact state when the fusing roller and pressing roller are put in press-contact with each other by the pressing spring.

3 Claims, 4 Drawing Sheets

FUSING DEVICE AND IMAGE FORMING APPARATUS USING THE SAME

This Nonprovisional application claims priority under 35 U.S.C. §119(a) on Patent Application No. 2008-009184 filed in Japan on 18 Jan. 2008, the entire contents of which are hereby incorporated by reference.

BACKGROUND OF THE INVENTION (1) Field of the Invention

The present invention relates to a fusing device and an image forming apparatus using the fusing device, and in particular relates to a fusing device that is made of a pair of roller elements functioning as a fusing roller and a pressing roller, to pass a recording medium with an unfixed toner image formed thereon to the contact nip where these roller elements are put in contact with each other, to thereby fix the toner image to the recording medium, as well as relating to an image forming apparatus using this fusing device.

(2) Description of the Prior Art

Conventionally, in image forming apparatus using electrophotography, such as facsimile machines, printers, etc., an image is output on a recording medium by charging a rotationally driven photoreceptor drum by a charger, forming an electrostatic latent image on the photoreceptor drum by irradiation with light in accordance with image information, applying toner to this electrostatic latent image from a developing unit to form a toner image, then transferring the toner image to a sheet material, paper or other recording media.

This image forming apparatus includes a fusing device that fuses and fixes the unfixed toner on the recording medium being conveyed. This fusing device, in most cases, is a thermal fusing roller type which is comprised of a pair of roller members, i.e., a fusing roller (heat roller) including a fusing source (heat generator) such as a halogen lamp and a pressing roller, arranged opposing each other at the position where the unfixed toner is fused and fixed. In this arrangement, the recording medium with an unfixed toner image thereon is passed through the press-contact area (fusing nip portion) where the two roller members press each other at a predetermined pressure, whereby the toner image on the recording medium is fixed to the recording medium (see patent document 1: Japanese Patent Application Laid-open 2007-248654).

However, the above conventional fusing device suffers the problem that pressing the roller members against each other for many hours by use of a pressing member such as a spring etc., causes partial permanent deformation in the elastic layer formed on the outer peripheral surface of the roller member.

As the measures against this problem, a prior art technique has been disclosed in which a fusing device includes a fusing roller having a thermal conductive member (metal core) that transfers heat from a heat generator to recording medium by thermal conduction and a pressing roller that has an elastic layer forming a nip portion with the fusing roller to convey the recording medium by nipping it, and is constructed such that while the distance from the thermal conductive member to the axis of the pressing roller is made constant regardless of whether the fusing device is activated or deactivated, the nip width during the fusing device being in operation is created by thermal expansion of the pressing rollers to thereby prevent partial deformation of the elastic layer of the pressing roller, which would arise when a spring or any other pressing element is used to impart a pressing force (see patent document 2: Japanese Patent Application Laid-open H08-22214).

However, in this prior arts the nip portion is created by causing the roller member to thermally expand without use of any pressing element such as a spring or the like, it was hence difficult to keep the pressing force and the nip width constant at any time. As a result there has been the problem that the fusing operation is unstable.

SUMMARY OF THE INVENTION

In view of the above problem, it is therefore an object of the present invention to provide a fusing device and an image forming apparatus using the fusing device which can realize stable fusing operation by preventing partial permanent deformation of its roller members.

The fusing device and image forming apparatus including this fusing device according to the present invention for solving the above problems are constructed as follows.

In accordance with the first aspect of the present invention, a fusing device that causes a recording medium with an unfixed toner image formed thereon to pass through a press-contact portion or so-called nip portion where roller members are put in press-contact with one another so as to fuse the toner image and fix it to the recording medium, includes: a pair of roller members functioning as a fusing roller and a pressing roller, at least one of the roller members having an elastic layer on the peripheral surface thereof; a pressing member for putting the roller members into press-contact with each other; and a roller member regulator for regulating the press-contact state between the roller members when the roller members are put into press-contact with each other by the pressing member.

In the above first configuration of the present invention, regulation of the press-contact state between the roller members can be also achieved by controlling the distance between the axes of the roller members.

In accordance with the second aspect of the present invention, the roller member regulator is preferably uses a part of a first supporting member for supporting a first roller that is one of the paired roller members and a part of a second supporting member for supporting the second roller member that is the other so as to regulate the press-contact state between the paired roller members by abutting the part of the first supporting member against the part of the second supporting member.

In accordance with the third aspect of the present invention, in addition to the above first or second feature, it is preferably that with the roller members put in press-contact with each other by the pressing member, the roller member regulator is adapted to create a necessary nip width for fusing toner images by thermal expansion of the roller members when a fusing operation for fusing and fixing toner images to recording mediums is activated.

In accordance with the fourth aspect of the present invention, in addition to the above second or third feature, it is preferably that the part of the first supporting member is a bearing element that rotatably supports the roller member.

In accordance with the fifth aspect of the present invention, in addition to any one of the above second to fourth configurations, it is preferred that the part of the second supporting member is a fixing element, e.g., snap ring, for fixing a bearing element that rotatably supports the roller member.

Further, the sixth aspect of the present invention resides in an image forming apparatus including a fusing device having any one of the above first through fifth features.

According to the first aspect of the present invention, since no pressing force greater than needed will be applied between the roller members, it is possible to prevent occurrence of partial permanent deformation in the elastic layers of the roller members, hence achieve a stable fusing operation.

According to the second aspect of the present invention, it is possible with a simple structure to prevent occurrence of partial permanent deformation in the elastic layers of the roller members without the necessity of providing a separate regulator and the like for regulating the press-contact state of the roller members.

According to the third aspect of the present invention, it is possible to assure the nip width necessary for fusing by thermal expansion of the roller members when a fusing operation is performed by the paired roller members.

According to the fourth aspect of the present invention, it is possible with a simple structure to construct the roller member regulator without the necessity of providing separate parts.

According to the fifth aspect of the present invention, it is possible with a simple structure to construct the roller member regulator without the necessity of providing separate parts.

According to the sixth aspect of the present invention, since a stable fusing operation can be carried out by preventing occurrence of partial permanent deformation in the elastic layers of the roller members, it is possible to provide an image forming apparatus which can stably achieve high-quality image printing with toner images reliably fused and fixed.

DESCRIPTION OF THE PREFERRED EMBODIMENTS

The embodiment of the present invention will hereinafter be described in detail with reference to the accompanying drawings.

An image forming apparatus 1 according to the present embodiment includes a fusing unit (fusing device) 6 which is comprised of a pair of roller members, a fusing roller 12 and a pressing roller 13, having an elastic layer on their outer peripheral surface, forming a press-contact portion or so-called nip portion in which fusing roller 12 and pressing roller 13 are put in contact, and causes a sheet of paper (recording medium) with an unfixed toner image formed thereon to pass through the nip portion so as to fuse the toner image and fix it to the paper. In this image forming apparatus, the fusing device characterized by the present invention is used as fusing unit 6.

To begin with, the overall configuration of image forming apparatus 1 according to the present embodiment will be described.

Figure 1:
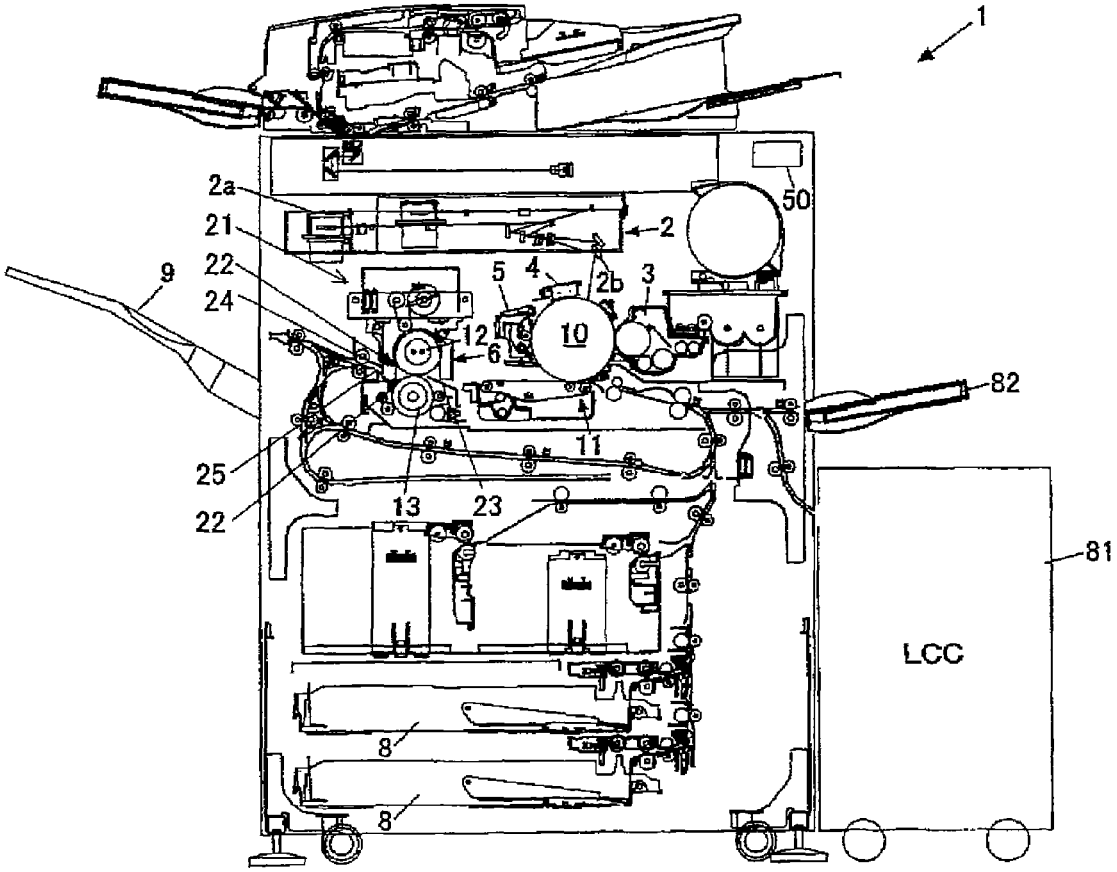
FIG. 1 is an illustrative view showing an overall configuration of an image forming apparatus which uses a fusing unit according to the embodiment of the present invention.

As shown in FIG. 1, image forming apparatus 1 forms a monochrome image on a predetermined sheet (recording paper) in accordance with image data transmitted from without or image data captured by image forming apparatus 1 itself, and includes an exposure unit 2, a developing unit 3, a photoreceptor drum 10, a transfer unit 11, a charger 4, a cleaning unit 5, a fusing unit (fusing device) 6, a paper feed tray 8, a paper output tray 9 and a controller 50.

Charger 4 is a charging device for uniformly electrifying the photoreceptor drum 10 surface at a predetermined potential. Charger 4 may employ a non-contact type or corona discharge type charger 4 shown in FIG. 1 or may use a contact type charger such as a roller type or a brush type.

Exposure unit 2 irradiates photoreceptor drum 10 that has been uniformly charged by charger 4, in accordance with the aforementioned image data so as to form an electrostatic latent image corresponding to the image data on the photoreceptor drum 10 surface.

As exposure unit 2, a laser scanning unit (LSU) including a laser emitter 2*a* and a reflection mirror 2*b* may be used. Alternatively, a writing head with an array of light emitting elements (EL or LEDs), for example may be used.

Here, in image forming apparatus 1 of the present embodiment, in order to achieve high-speed printing operation, a method for alleviating the rush of irradiation timings by using a multiple number of laser beams, namely a two-beam method, is adopted.

Developing unit 3 visualizes the electrostatic latent image formed on the photoreceptor drum 10 surface with toner, black toner herein, to form a toner image.

Transfer unit 11 transfers the toner image developed on photoreceptor drum 10 by developing unit 3 to a sheet of paper that is being conveyed.

Fusing unit 6 causes the paper with an unfixed toner image transferred thereon by transfer unit 11 to pass through the press-contact portion (which will be referred to hereinbelow as "fusing nip portion") between rotatable fusing roller (roller member) 12 and pressing roller (roller member) 13 that is put in press-contact with the fusing roller 12 so as to fuse the toner image on the paper and fix it to the paper. Details of fusing unit 6 will be described later.

Cleaning unit 5 removes and collects the toner remaining on the photoreceptor drum 10 surface after development and image transfer.

Paper feed tray 8 is a tray for stacking sheets of paper used for image forming. Since, in the present embodiment, in order to deal with a large volume of high-speed printing processing, a multiple number of paper feed trays 8, 8 each capable of stacking 500 to 1500 sheets of standard-sized paper are arranged under image forming apparatus 1. Further, a large-capacity paper feed cassette (LCC) 81 capable of storing multiple kinds of paper in large volumes and a manual feed tray 82 for mainly supporting printing for irregular sized paper are arranged at the side of image forming apparatus 1.

Paper output tray 9 stacks the paper processed through image forming. This paper output tray 9 is arranged on the opposite side across image forming apparatus 1 from that of manual feed tray 82. It is also possible to configure such a system that instead of paper output tray 9, a post-processing machine for stapling, punching and performing other processes of, the sheets of paper after image forming, and/or a multi-bin paper output tray may be arranged as an option.

Controller 50 performs operational controls of the aforementioned individual components and also performs image processing of image data. Controller 50 is a micro computer including, at least, a CPU and RAM, and functions to operate based on the programs recorded on an unillustrated recording medium.

Figure 2:
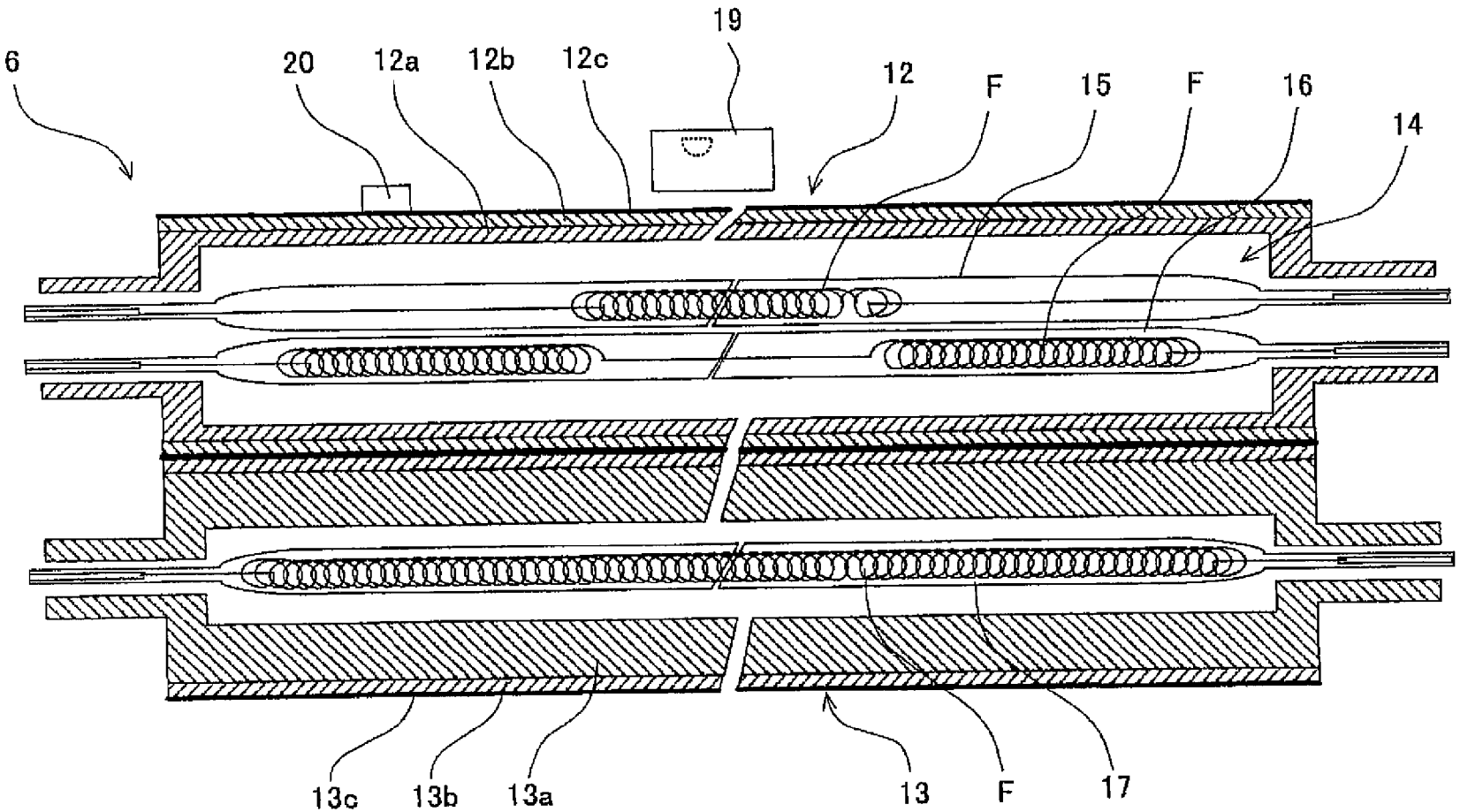
FIG. 2 is a schematic sectional view showing the configuration of the fusing unit.

Next, fusing unit 6 that characterizes the present embodiment will be described in detail with reference to the drawings. FIG. 2 is a schematic sectional view showing the configuration of the fusing unit according to the present embodiment.

As shown in FIG. 2, fusing unit 6 is composed of fusing roller 12 and pressing roller 13 arranged opposing each other so that pressing roller 13 will be put into press-contact with fusing roller 12.

Fusing roller 12 is heated at a predetermined temperature to apply heat to the paper with a toner image (unfixed) formed thereon that passes through the fusing nip portion. This fusing roller 12 has a cylindrical body formed of a prime pipe 12*a* made of metal such as iron, stainless steel, aluminum, copper, etc., alloy of these or the like, and silicone rubber (of 1 to 3 mm thick) covered on the pipe as an elastic layer 12*b*.

Elastic layer 12*b* of silicone rubber has a heat storage function. Formed on this elastic layer 12*b* is a releasing layer 12*c* made of fluororesin such as PFA (copolymer of tetrafluoroethylene-perfluoroalkyl vinyl ether), PTFE (polytetrafluoroethylene) or the like.

Fusing roller 12 also includes a heating device (heat source) 14 in the hollow of the cylindrical body for setting the fusing roller 12 surface at a temperature required for fusing the toner image. The surface of fusing roller 12 is heated by this heating device 14 to a predetermined set temperature for fusing. The set temperature for fusing is typically 160 to 200 deg. C., and is set at 180 deg. C. in the present embodiment.

Heating device 14 includes two heat sources, main heater (center heat source or main heat source) 15 and sub heater (side heat source or sub heat source) 16 so that they can heat the fusing roller 12 surface separately in the center portion and in the side portions, respectively. Main heater 15 is formed of a coiled filament F arranged in the central area of fusing roller 12. This coil of filament F forms a heat-generating portion so as to heat the center area of fusing roller 12. On the other hand, sub heater 16 has a pair of coils of filament F located at both side ends outside the heat-generating portion of main heater 15. These portions where coils of filament F are located form heat generating areas so as to heat both side parts of fusing roller 12.

Arranged at the center and at one side of fusing roller 12 are temperature sensors 19 and 20, which comprise thermistors for detecting the temperature of the fusing roller 12 surface. These temperature sensors 19 and 20 constitute the temperature detecting means for detecting the surface temperature of the portions corresponding to the heat generating areas of main heater 15 and sub heater 16 that can separately heat the fusing roller 12 surface.

Temperature sensor 19 is the centered temperature sensor for detecting the temperature of the center area of fusing roller 12 and is arranged out of contact with the fusing roller 12 surface. On the other hand, temperature sensor 20 is the side area temperature sensor for detecting the temperature at the side area of fusing roller 12 and is arranged in contact with fusing roller 12.

In the present embodiment, since the paper passes through the central part of fusing roller 12 more frequently than the side areas, centered temperature sensor 19 is more likely to be damaged by the paper that sticks to the fusing roller 12 surface. This is why temperature sensor 19 is kept out of contact with the roller surface.

Further, in the present embodiment, the temperature controller (not shown) included in controller 50 is adapted to calibrate the temperature detected by centered temperature sensor 19 for the temperature discrepancy resulting from the gap distance from the fusing roller 12 surface.

On the other hand, pressing roller 13 has a cylindrical body formed of a prime pipe 13*a* made of metal such as iron, stainless steel, aluminum, copper, etc., alloy of these or the like, and silicone rubber (of 1 to 5 mm thick) covered on the pipe as an elastic layer 13*b*. Similarly to fusing roller 12, elastic layer 13*b* of silicone rubber has the heat storage function. Formed on this elastic layer 13*b* is a releasing layer 13*c* made of fluororesin such as PFA (copolymer of tetrafluoroethylene-perfluoroalkyl vinyl ether), PTFE (polytetrafluoroethylene) or the like.

Further, in the present embodiment, pressing roller 13 also incorporates a heating means (heat source) or heater (which will be referred to herein below as pressing side heater) 17 so as to suppress the amount of heat from being taken away from fusing roller 12 by pressing roller 13.

Pressing side heater 17 has a coil of filament F that extends along the axis of pressing roller 13 so as to oppose the approximately full length of fusing roller 12. This coil of filament F constitutes a heat generating part, or heats fusing roller 12 as a whole across the approximately full length of it.

Each of the thus constructed fusing roller 12 and pressing roller 13 has paper separation claws 22, 22 for peeling the paper that sticks to the outer periphery of fusing roller 12 or pressing roller 13, as shown in FIG. 1. A cleaning unit 21 for removing toner adhering to the fusing roller 12 surface is provided on the outer periphery of fusing roller 12.

As shown in FIG. 1, the paper guided from transfer unit 11 to fusing unit 6 along a paper guide 23 passes through the fusing nip portion between fusing roller 12 and pressing roller 13, then the paper is peeled from fusing roller 12 or pressing roller 13 by paper separation claws 22, 22 and guided along paper guides 24 and 25. The surface of fusing roller 12 after the paper is peeled off is cleaned by cleaning unit 21.

Now, one example of fusing unit 6 according to the present embodiment will be described with reference to the drawings.

Figure 3A:
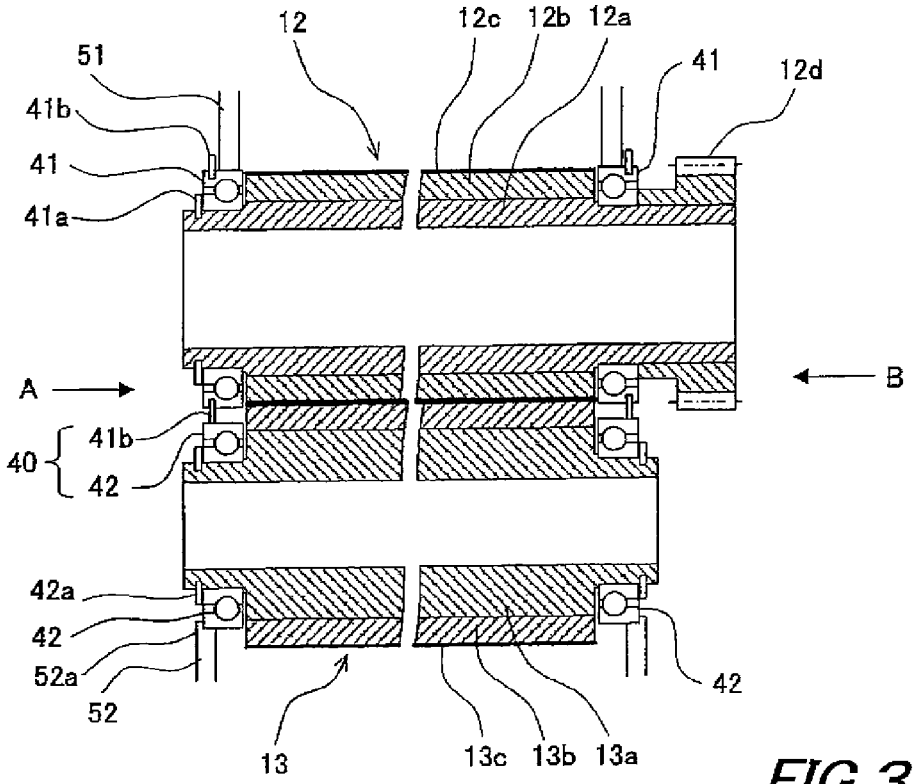
FIG. 3A is a sectional view showing one example of a fusing roller and pressing roller that constitute the fusing unit, FIG. 3B a side view, viewed in the direction of an arrow A in FIG. 3A, and FIG. 3C a side view, viewed in the direction of an arrow B in FIG. 3A; and, FIG. 4 is an illustrative view showing a state in which the fusing roller and pressing roller are put in press-contact with each other.
Figure 3B:
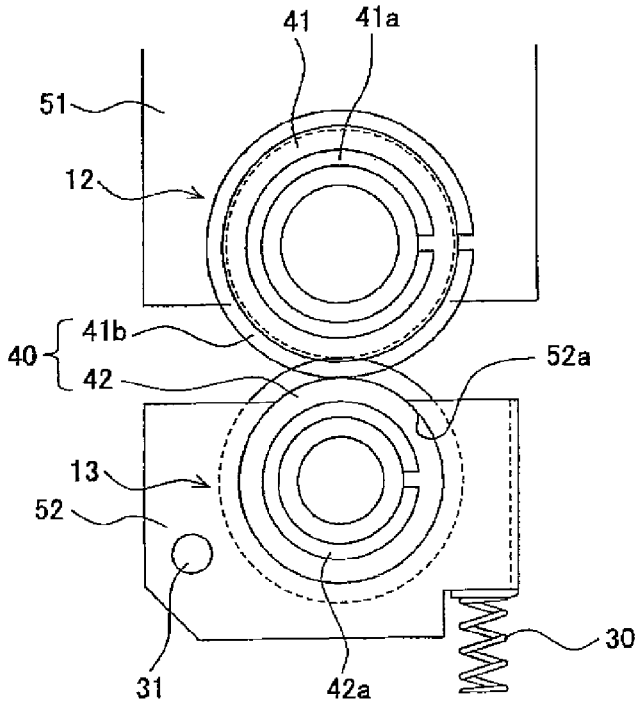
Figure 3C:
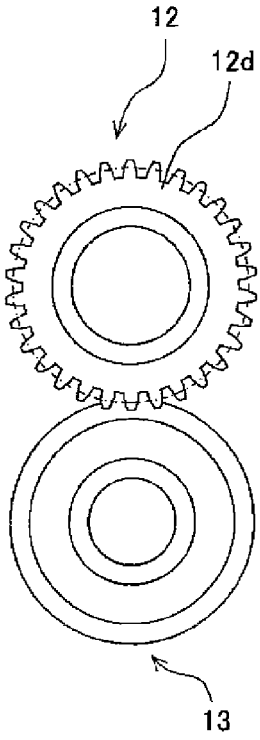
Figure 4:
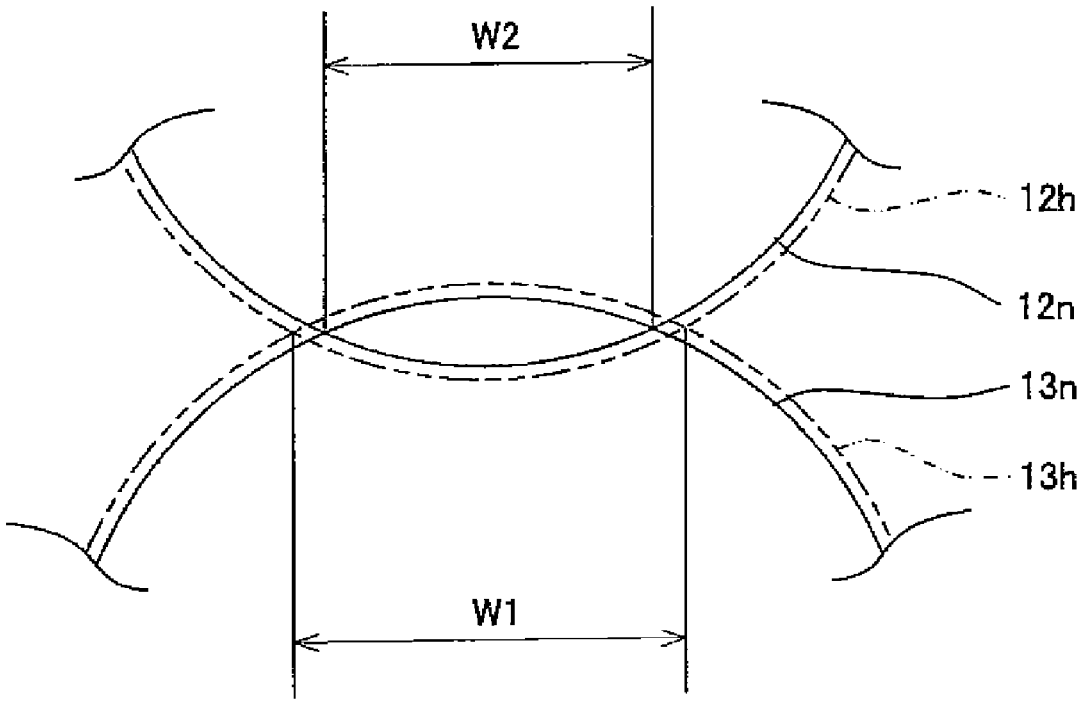

FIG. 3A is a sectional view showing one exemplary configuration of a fusing roller and pressing roller that constitute the fusing unit of the present invention, FIG. 3B is a side view, viewed in the direction of an arrow A in FIG. 3A, and FIG. 3C is a side view, viewed in the direction of an arrow B in FIG. 3A. FIG. 4 is an illustrative view showing a state in which the fusing roller and pressing roller are put in press-contact with each other.

As shown in FIG. 3A, fusing roller 12 has a cylindrical body having an outside diameter of 40 mm, comprised of prime tube 12*a*, silicone rubber of 1.5 mm thick formed as elastic layer 12*b* on the outer peripheral side of the prime tube 12*a* and a releasing layer 12*c* of PFA formed with a thickness of 30 μm on the elastic layer 12*b*. Similarly, pressing roller 13 has a cylindrical body having an outside diameter of 40 mm, comprised of prime tube 13*a*, silicone rubber of 1.5 mm thick formed as elastic layer 13*b* on the outer peripheral side of the prime tube 13*a* and a releasing layer 13*c* of PFA formed with a thickness of 30 μm on the elastic layer 13*b*.

As shown in FIGS. 3A and 3B, fusing roller 12 and pressing roller 13 have respective bearings (supporting members) 41 and 42 for rotatably supporting the rollers, inserted at both ends. That is, fusing roller 12 is rotatably attached to an upper unit 51 by means of bearings 41 and pressing roller 13 is rotatably attached to a lower unit 52 by means of bearings 42.

Bearing 41 inserted in fusing roller 12 is fixed to fusing roller 12 by a snap ring 41*a* attached to the fusing roller 12 side and is positioned to upper unit 51 by another snap ring 41*b* attached to the outer ring of bearing 41.

Bearing 42 inserted in pressing roller 13 is fixed to pressing roller 13 by a snap ring 42*a* attached to the pressing roller 13 side while the outer ring of bearing 42 is positioned to and supported by an attachment portion 52*a* of lower unit 52.

Snap ring 41*b* attached to the outer ring of bearing 41 and bearing 42 are arranged so that the outer periphery of snap ring 41*b* and the outer periphery of bearing 42 abut each other when fusing roller 12 and pressing roller are put in press-contact. That is, these function as a roller member regulator 40 for regulating the press-contact state between fusing roller 12 and pressing roller 13.

Arranged on one end of fusing roller 12 is a drive transmission gear 12*d*, as shown in FIGS. 3A and 3C. Fusing roller 12 is coupled to and rotationally driven by a drive source (not shown) via this drive transmission gear 12*d*. Pressing roller 13 is adapted to be driven following the rotation of fusing roller 12 with its roller surface put in contact with the fusing roller 12 surface.

As shown in FIG. 3B, a pressing spring (pressing member) 30 for a press-contact mechanism (not shown) is provided at one end portion of lower unit 52 on the far side from the fusing roller side. This pressing spring 30 is arranged so as to urge lower unit 52 toward fusing roller 12 side with a predetermined force about a pivot or a rotary axis 31 formed at the other end portion of lower unit 52 on the far side from the fusing roller side. That is, pressing spring 30 is adapted to press pressing roller 13 against fusing roller 12 with a predetermined force.

Next, the operation of fusing roller 12 and pressing roller 13 in fusing unit 6 will be described.

As shown in FIGS. 3A and 3B, in fusing unit 6 in its normal state, pressing roller 13 is constantly put in press-contact with fusing roller 12 by pressing spring 30. Accordingly, in the ready state of image forming apparatus 1, pressing roller 13 is put in a state where it is urged against fusing roller 12 for many hours.

In this condition, since snap ring 41*b* on the fusing roller 12 side and the outer periphery of bearing 42 on the pressing roller 13 side are put in contact, the amount of pressing roller 13 being pressed against fusing roller 12 is regulated, so that the pressing force by pressing spring 30 is suppressed. As a result, even if pressing roller 13 is put in a state where it has urged fusing roller 12 for many hours, it is possible to prevent elastic layers 12*b* and 13*b* of fusing roller 12 and pressing roller 13 from being partially deformed permanently.

As the amount of pressing roller 13 being pressed against fusing roller 12 is controlled as stated above, it becomes difficult to assure the nip width necessary for fusing the toner image between fusing roller 12 and pressing roller 13. To deal with this, in the present embodiment, the outside dimension of snap ring 41*b* is designated so that the nip width W1 between fusing roller 12 and pressing roller 13, required at the time of toner fusing (fusing temperature: 180 deg. C.) is 4.5 mm and the nip width W2 between fusing roller 12 and pressing roller 13 at normal temperature (25 deg. C.) is 4.0 mm in order to prevent occurrence of partial permanent deformation in elastic layers 12*b* and 13*b* of fusing roller 12 and pressing roller 13 during normal state.

The two-dot chain lines designated by reference numerals 12*h* and 13*h* shown in FIG. 4 represent the circumferences of fusing roller 12 and pressing roller 13 at the time of toner fusing while the solid lines designated by reference numerals 12*n* and 13*n* represent the circumferences of fusing roller 12 and pressing roller 13 at normal temperature.

As described above, according to the present embodiment, in fusing unit 6, roller member regulator 40 for regulating the press-contact state between fusing roller 12 and pressing roller 13 is constructed by abutment between snap ring 41*b* on the fusing roller 12 side and the outer periphery of bearing 42 on the pressing roller 13 side, it is hence possible to reduce the pressing force imparted by pressing spring 30 when the apparatus is deactivated or in the ready state and prevent occurrence of partial permanent deformation in elastic layers 12*b* and 13*b* of fusing roller 12 and pressing roller 13.

Further, according to the present embodiment, since roller member regulator 40 for regulating the press-contact state between fusing roller 12 and pressing roller 13 is formed by the combination of snap ring 41*b* attached to the outer ring of bearing 41 and bearing 42, it is possible to realize a simple and space-saving apparatus configuration without providing a separate roller member regulator.

In the above-described embodiment, though the roller member regulator 40 is realized by abutment between snap ring 41*b* on the fusing roller 12 side and the outer periphery of bearing 42 on the pressing roller 13 side, the present invention should not be limited to this configuration of roller member regulator 40. For example, the arrangement and functions of bearings 41 and 42 attached to fusing roller 12 and pressing roller 13 may be made opposite.

Also, as the roller member regulator, for example, some abutment portions that abut each other when fusing roller 12 and pressing roller 13 are put in press-contact, may be formed in upper unit 51 and lower unit 52 that constitute part of the supporting components for supporting fusing roller 12 and pressing roller 13. This arrangement makes it possible to increase design flexibility of the supporting members that directly hold fusing roller 12 and pressing roller 13 and also create the roller member regulator without being affected by the supporting members.

Further, in the above-described example, the particular constituents, such as the outside diameters of fusing roller 12 and pressing roller 13, the thicknesses of elastic layers 12*b*, 13*b* and releasing layers 12*c*, 13*c*, were specified numerically. However, since the conditions under which permanent deformation occurs will vary depending on the hardness and thickness of the elastic layers and also the nip width necessary for toner fusing will vary depending on the speed of paper conveyance, the present invention should not be limited to the above example, and the above factors can be designated as appropriate at the optimal numeric values.

As described heretofore, application of fusing unit 6 according to the present invention to image forming apparatus 1 makes it possible to prevent occurrence of partial permanent deformation in elastic layers 12*b* and 13*b* of fusing roller 12 and pressing roller 13, it is hence possible to effect a stable fusing operation. As a result, it is possible to stably achieve high-quality image printing with toner images reliably fused and fixed.

Having described the preferred embodiment modes of the present invention, it goes without saying that the present invention should not be limited to the above-described examples, and it is obvious that various changes and modifications will occur to those skilled in the art within the scope of the appended claims. Such variations are therefore understood to be within the technical scope of the present invention.

For example, in the above embodiment, the present invention is applied to a monochrome image forming apparatus, but the present invention can also be applied to a color image forming apparatus including a fusing device that fuses and fixes a toner image to a recording medium.

What is claimed is:

1. A fusing device that causes a recording medium with an unfixed toner image formed thereon to pass through a press-contact nip portion where roller members are put in press-contact with one another so as to fuse the toner image and fix it to the recording medium during a fusing operation, comprising:

a pair of roller members functioning as a fusing roller and a pressing roller, at least one of the roller members having an elastic layer on the peripheral surface thereof;

a pressing member operable to constantly put the roller members into press-contact with each other to form the press-contact nip portion even when no recording medium is passing through the press-contact nip portion in a normal state existing prior to or after the fusing operation; and a roller member regulator operable to regulate the press-contact state between the roller members when the roller members are put into constant press-contact with each other by the pressing member in the normal state to form a width of the press-contact nip portion under a pressure that prevents the elastic layer on the at least one roller from being partially deformed permanently, while permitting the width of the press-contact nip portion to become wider during the fusing operation, wherein the roller member regulator uses a part of a first supporting member for supporting a first roller that is one of the paired roller members and a part of a second supporting member for supporting the second roller member that is the other so as to regulate the press-contact state between the paired roller members by abutting the part of the first supporting member against the part of the second supporting member, the part of the first supporting member is a bearing element that rotatably supports the roller member, and the part of the second supporting member is a fixing element for fixing a bearing element that rotatably supports the roller member.

2. The fusing device according to claim 1, wherein with the roller members put in press-contact with each other by the pressing member, the roller member regulator is adapted to create the wider width of the press-contact nip portion during the fusing operation by thermal expansion of the roller members when the fusing operation is activated.

3. An image forming apparatus including a fusing device specified in claim 1.

* * * * *